US007815087B2

(12) United States Patent
Jian

(10) Patent No.: US 7,815,087 B2
(45) Date of Patent: Oct. 19, 2010

(54) NAIL GUN WITH AN ANGLE-ADJUSTABLE MAGAZINE

(75) Inventor: Jia-Liang Jian, Taichung Hsien (TW)

(73) Assignee: Rexon Industrial Corp. Ltd., Taichung Hsien (TW)

( * ) Notice: Subject to any disclaimer, the term of this patent is extended or adjusted under 35 U.S.C. 154(b) by 256 days.

(21) Appl. No.: 12/192,495

(22) Filed: Aug. 15, 2008

(65) Prior Publication Data

US 2009/0045239 A1 Feb. 19, 2009

(30) Foreign Application Priority Data

Aug. 17, 2007 (TW) ..... 96130479 A

(51) Int. Cl.
*B25C 1/04* (2006.01)
*B25F 5/00* (2006.01)

(52) U.S. Cl. ..... 227/120; 227/119; 227/148

(58) Field of Classification Search ..... 227/120, 227/148, 8, 140, 109, 119
See application file for complete search history.

(56) References Cited

U.S. PATENT DOCUMENTS 3,007,171 A * 11/1961 Critchley ..... 227/109
4,126,258 A * 11/1978 Martin et al. ..... 227/8
4,197,974 A * 4/1980 Morton et al. ..... 227/8
4,558,811 A * 12/1985 Klaus ..... 227/116
4,598,852 A * 7/1986 Olesen ..... 227/119
4,688,710 A * 8/1987 Massari et al. ..... 227/109
5,579,975 A * 12/1996 Moorman ..... 227/8
5,803,338 A * 9/1998 Singer et al. ..... 227/8
6,045,024 A * 4/2000 Phillips ..... 227/130
6,189,759 B1 * 2/2001 Canlas et al. ..... 227/120
6,609,646 B2 * 8/2003 Miller et al. ..... 227/8
6,641,020 B1 * 11/2003 Yao ..... 227/109
6,779,697 B2 * 8/2004 Lin ..... 227/120
6,880,739 B1 * 4/2005 Zhu ..... 227/109
6,932,261 B2 * 8/2005 Huang ..... 227/120
6,938,809 B1 * 9/2005 Schnell ..... 227/8
7,000,817 B1 * 2/2006 Wang ..... 227/109
7,025,242 B1 * 4/2006 Schnell ..... 227/120
7,028,875 B1 * 4/2006 Beville et al. ..... 227/8
7,325,709 B2 * 2/2008 Ishizawa et al. ..... 227/120
7,387,228 B2 * 6/2008 Yeh et al. ..... 227/120
7,441,683 B2 * 10/2008 Ishizawa et al. ..... 227/120
D582,743 S * 12/2008 Buck ..... D8/69
7,600,662 B2 * 10/2009 Nayrac et al. ..... 227/120
2003/0230622 A1 * 12/2003 Rotharmel ..... 227/120
2006/0102683 A1 * 5/2006 Schnell et al. ..... 227/119
2006/0108389 A1 * 5/2006 Phillips ..... 227/120
2007/0114259 A1 * 5/2007 Bromley et al. ..... 227/120
2009/0050665 A1 * 2/2009 Jian et al. ..... 227/119
2009/0050668 A1 * 2/2009 Jian ..... 227/126
2009/0242608 A1 * 10/2009 Dittrich et al. ..... 227/120

* cited by examiner

*Primary Examiner*—Rinaldi I. Rada
*Assistant Examiner*—Lindsay Low
(74) *Attorney, Agent, or Firm*—Stephen A. Bent; Foley & Lardner LLP

(57) ABSTRACT

A nail gun includes a body, a handle, a nail ejection member, and a nail magazine unit. The nail magazine unit includes two parallel cranks connected pivotally to the nail ejection member, and a link having two ends connected respectively and pivotally to free ends of the cranks.

10 Claims, 10 Drawing Sheets

NAIL GUN WITH AN ANGLE-ADJUSTABLE MAGAZINE

CROSS-REFERENCE TO RELATED APPLICATION

This application claims priority of Taiwanese Application No. 096130479, filed on Aug. 17, 2007.

BACKGROUND OF THE INVENTION

1. Field of the Invention

This invention relates to a nail gun, and more particularly to a nail gun having an angle-adjustable magazine.

2. Description of the Related Art

Referring to FIG. 1, a first conventional nail gun includes a body 1, a vertical nail ejection member 2, and a horizontal nail magazine 4 for receiving a rectangular nail strip 5.

With reference to FIG. 2, a second conventional nail gun includes a body 1', a nail ejection member 2', and an inclined nail magazine 4' extending outwardly and upwardly from the nail ejection member 2' for receiving a parallelogram nail strip 5'.

To increase the flexibility to use in various working spaces, a third conventional nail gun includes a body 7, a nail ejection member 8, and an angle-adjustable nail magazine 9. However, since the nail magazine 9 is connected to the nail ejection member 8 by only one pivot member 801, a gap 901 is formed between the nail magazine 9 and the nail ejection member 8, thereby affecting adversely smooth movement of the nails from the nail magazine 9 into the nail ejection member 8.

SUMMARY OF THE INVENTION

The object of this invention is to provide a nail gun that does not have any gap formed between a nail ejection member and an angle-adjustable nail magazine.

According to this invention, a nail gun includes a body, a handle, a nail ejection member, and a nail magazine unit. The nail magazine unit includes two parallel cranks connected pivotally to the nail ejection member, and a link having two ends connected respectively and pivotally to free ends of the cranks. As such, no gap is formed between the nail ejection member and the nail magazine unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
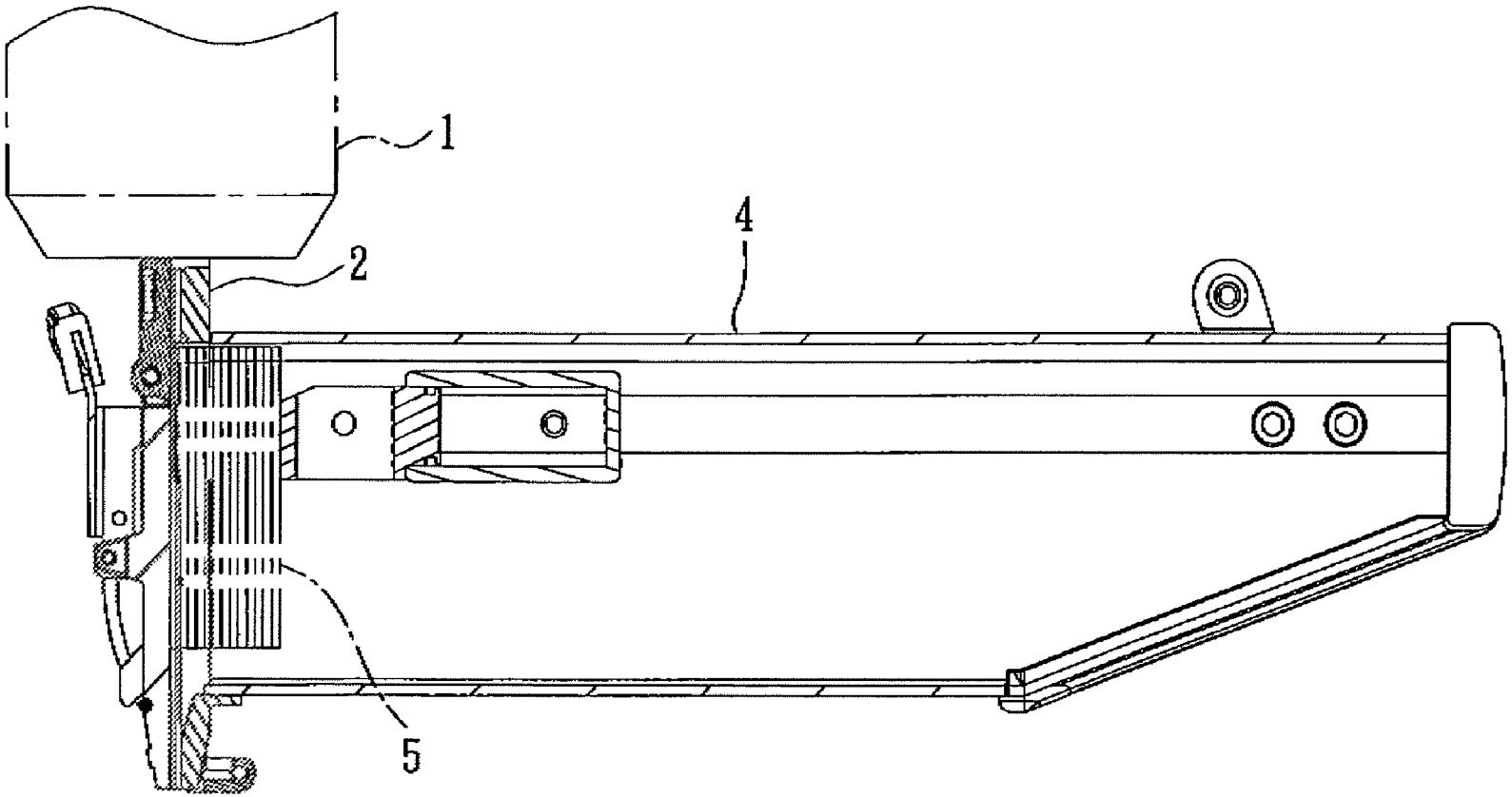
FIG. 1 PRIOR ART
FIG. 1 is a fragmentary schematic view of a first conventional nail gun.
Figure 2:
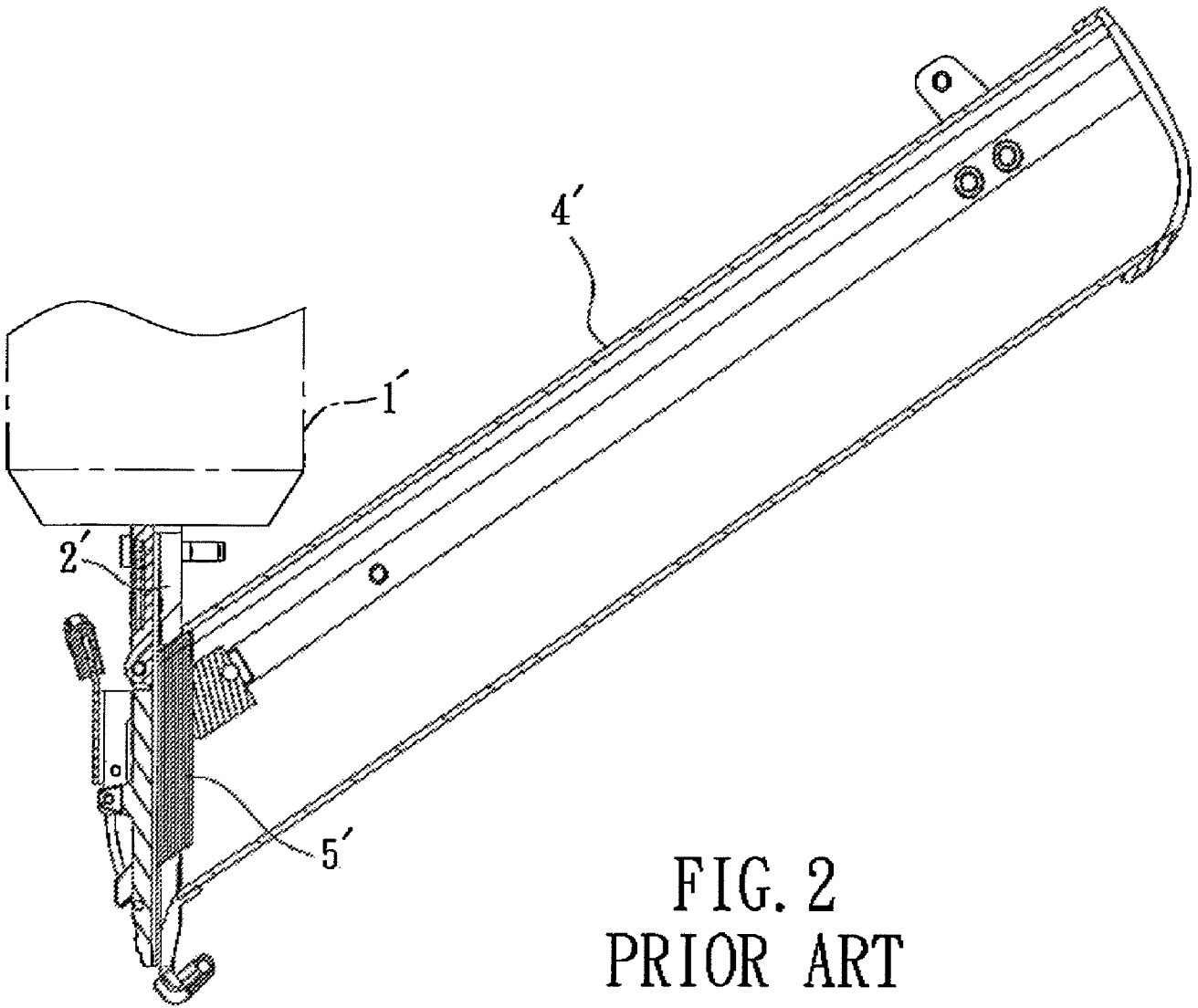
FIG. 2 PRIOR ART
FIG. 2 is a fragmentary schematic view of a second conventional nail gun.
Figure 3:
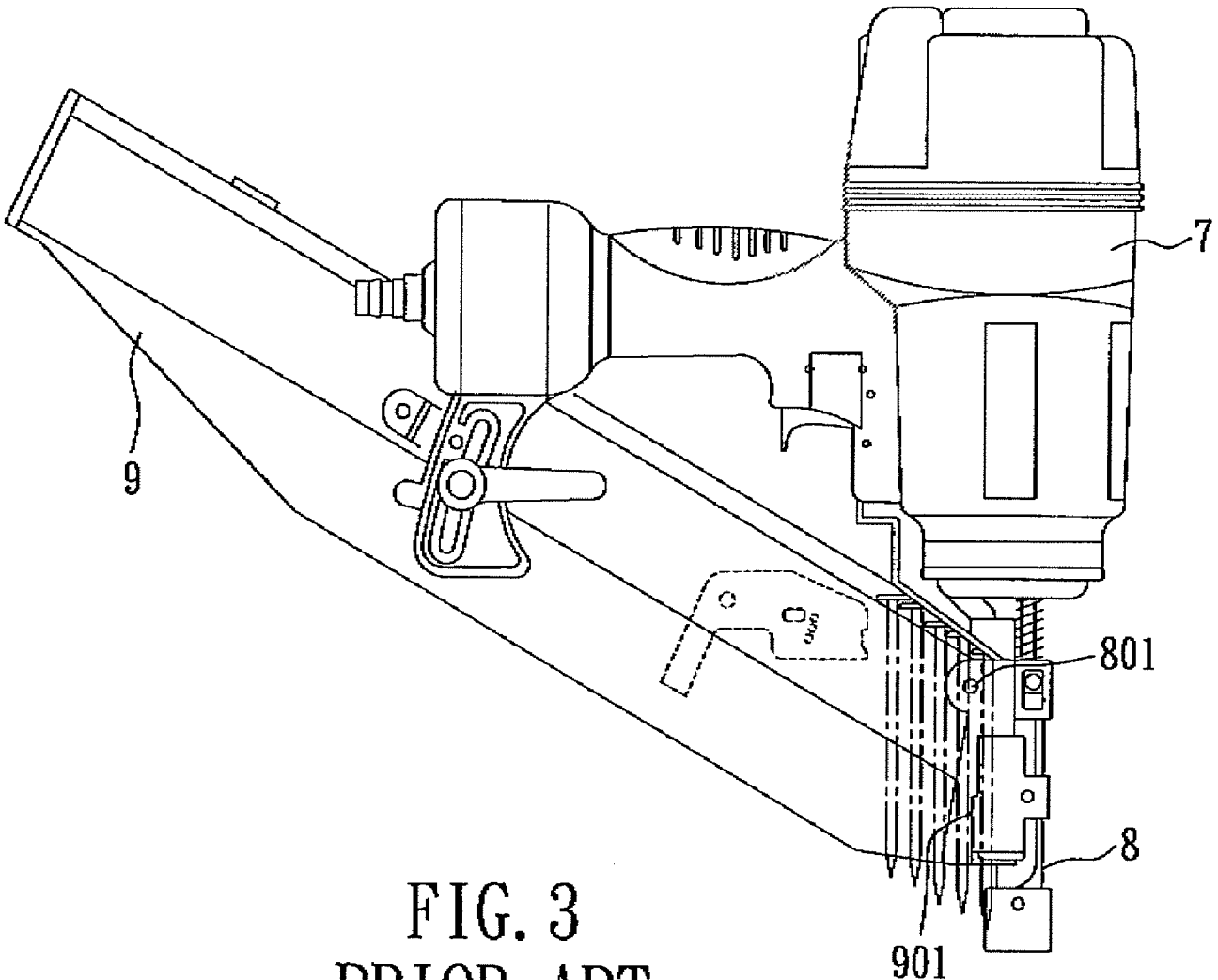
FIG. 3 PRIOR ART
FIG. 3 is a fragmentary schematic view of a third conventional nail gun.

In the following description, directional terms including "vertical", "upper", "lower", and other similar terms will be used to refer to the nail gun in a convenient orientation, in which the nail gun is shown in the drawings. It should be understood that this invention is not limited to any particular orientation.

Figure 4:
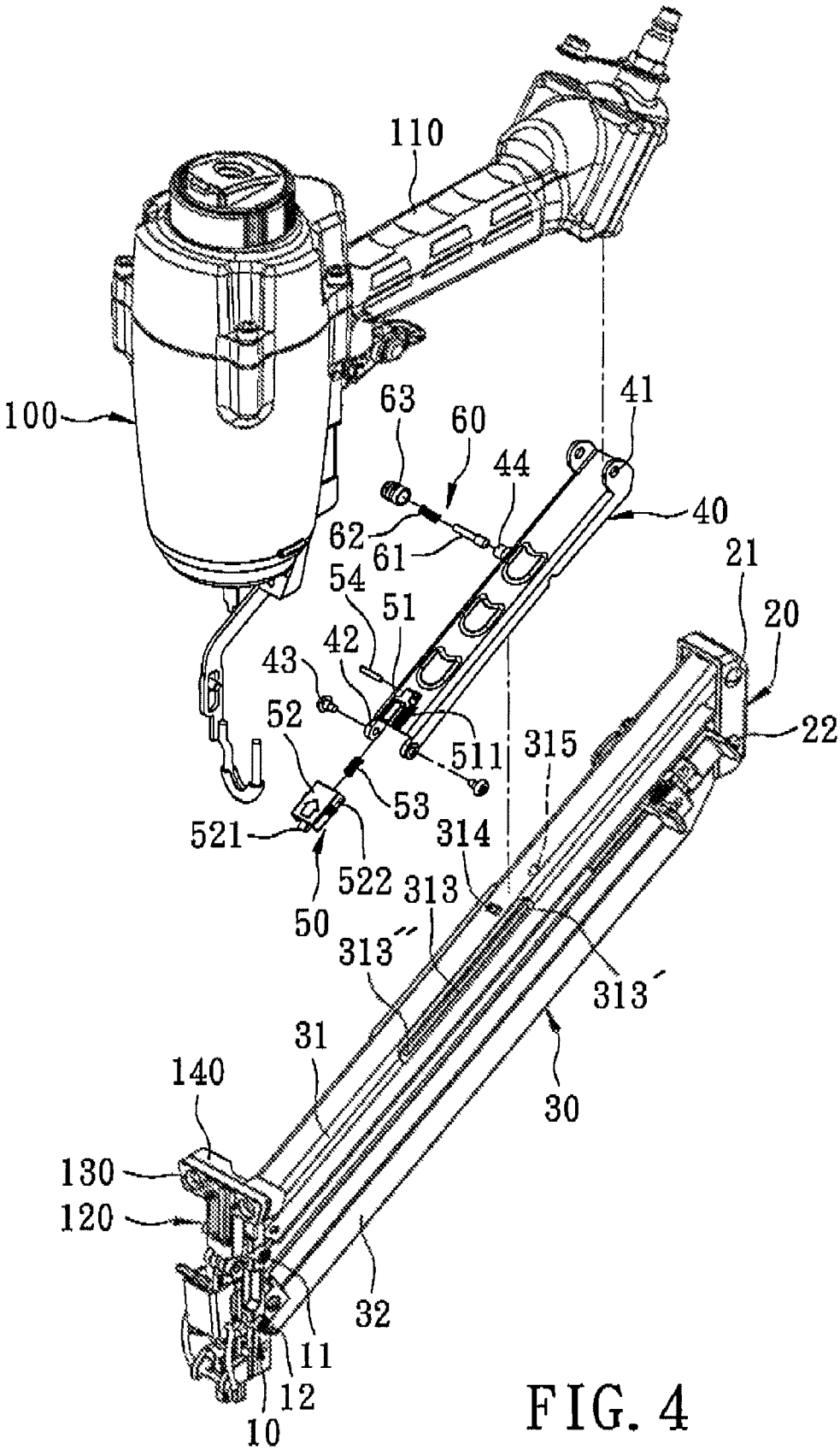
FIG. 4 is a partly exploded perspective view of the preferred embodiment of a nail gun according to this invention.
Figure 5:
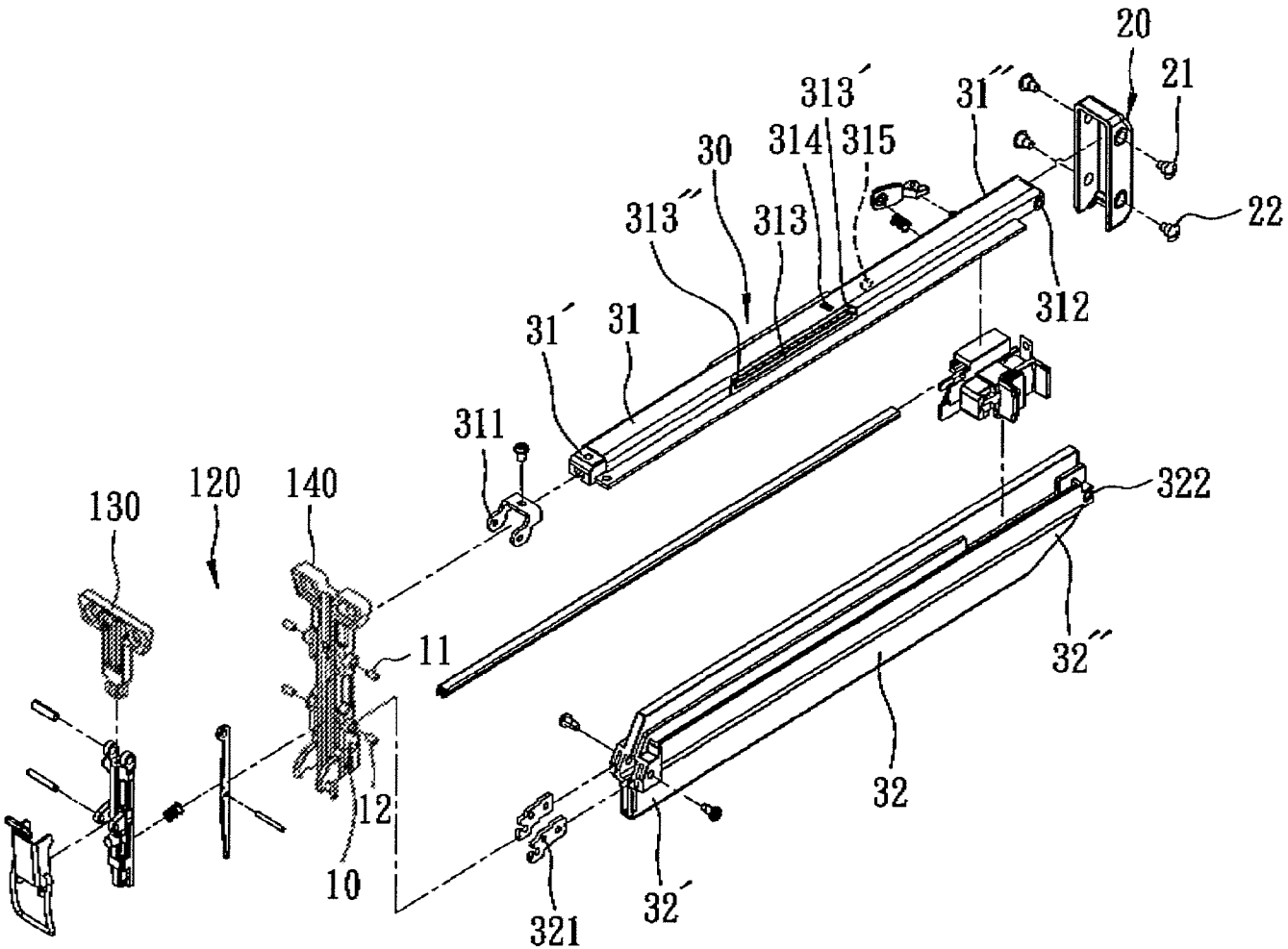
FIG. 5 is a fragmentary exploded perspective view of the preferred embodiment, illustrating a nail magazine unit.
Figure 9:
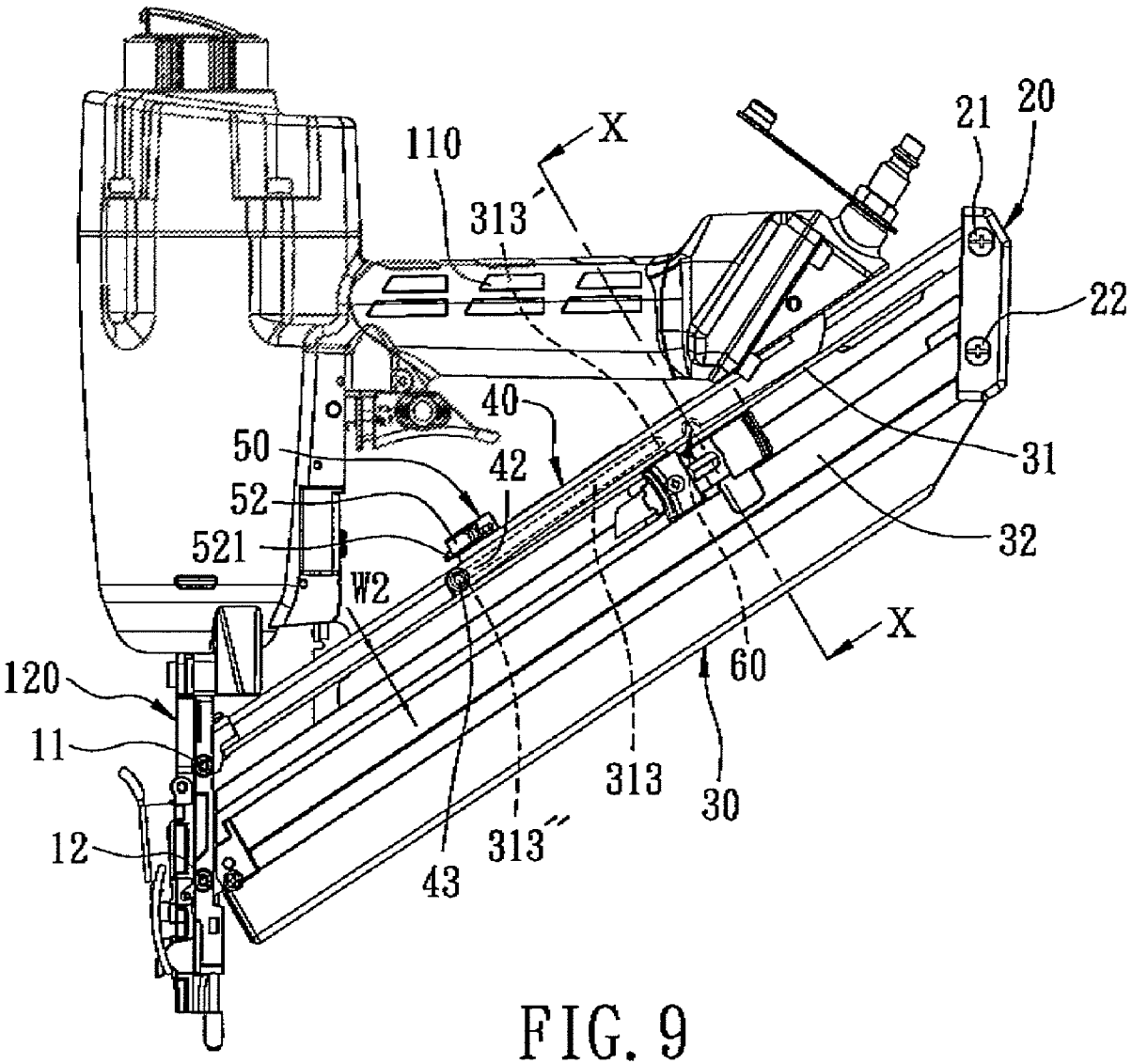
FIG. 9 is a view similar to FIG. 6 but illustrating the magazine member in an inclined position.

Referring to FIGS. 4 and 5, the preferred embodiment of a nail gun according to this invention includes a body 100, a handle 110 connected fixedly to and extending laterally from the body 100, a nail ejection member 120 connected to and disposed under the body 100 and extending along a vertical direction, and a nail magazine unit. The nail ejection member 120 includes a nail ejection plate 130 and an intermediate plate 140 disposed fixedly on a side surface of the nail ejection plate 130. The nail magazine unit includes a first connecting member 10, a second connecting member or link 20, a magazine member 30, a connecting rod 40, a first positioning unit 50, and a second positioning unit 60. The magazine member 30 is pivotable relative to the nail ejection member 120 between a horizontal position shown in FIG. 6 and an inclined position shown in FIG. 9, and includes an elongated upper crank 31 and an elongated lower crank 32 disposed under and parallel to the upper crank 31. In the horizontal position, the magazine member 30 is perpendicular to the nail ejection member 120. In the inclined position, the magazine member 30 is inclined relative to the nail ejection member 120.

Each of the upper and lower cranks 31, 32 has a proximate end 31', 32' proximate to the nail ejection member 120, and a free end or distal end 31", 32" distal from the nail ejection member 120.

The first connecting member 10 is connected fixedly to the intermediate plate 140 of the nail ejection member 120, and has an upper pivot portion 11 connected pivotally to the proximate end 31' of the upper crank 31, and a lower pivot portion 12 connected pivotally to the proximate end 32' of the lower crank 32. As such, the upper and lower cranks 31, 32 are pivotable relative to the nail ejection member 120.

The second connecting member 20 has an upper pivot portion 21 connected pivotally to the distal end 31" of the upper crank 31, and a lower pivot portion 22 connected pivotally to the distal end 32" of the lower crank 32. As such, a parallelogram linkage is constituted by the upper and lower cranks 31, 32, as well as the first and second connecting members 10, 20.

In this embodiment, each of the upper pivot portions 11, 21 and the lower pivot portions 12, 22 of the first and second connecting members 10, 20 is configured as a pivot pin unit. Each of the proximate ends 31', 32' and the distal ends 31", 32" of the upper and lower cranks 31, 32 has a pivot hole unit 311, 321, 312, 322 engaging the corresponding pivot pin unit.

The upper crank 31 further has a guide slot 313 extending along a longitudinal direction thereof and formed therethrough along a transverse direction thereof. The guide slot 313 has a first end 313' distal from the nail ejection member 120, and a second end 313" proximate to the nail ejection member 120.

The connecting rod 40 has an upper end 41 connected pivotally to an end of the handle 110, and a lower end 42 formed with an integral sliding member 43 disposed movably within the guide slot 313 in the upper crank 31.

Figure 6:
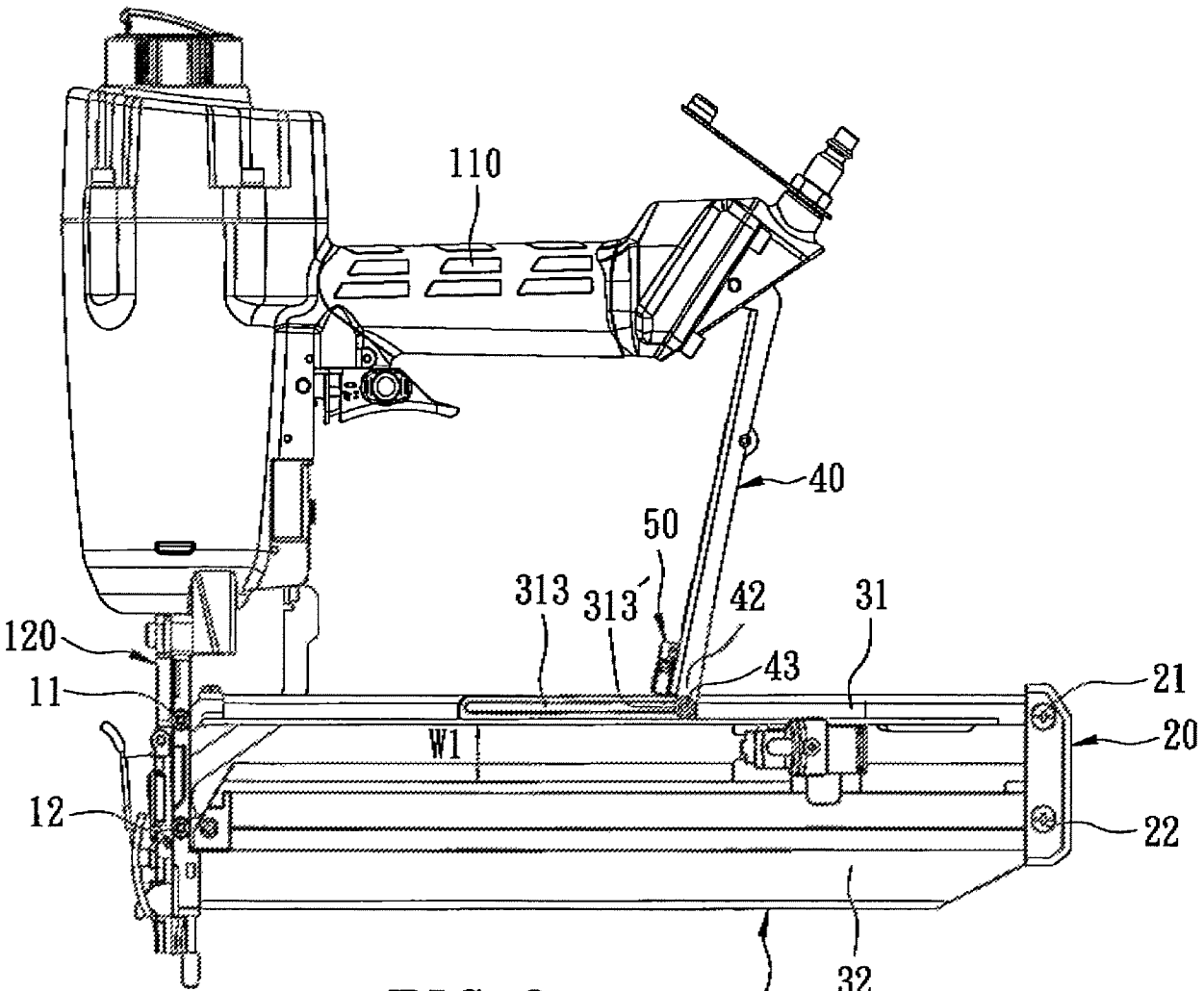
FIG. 6 is a side view of the preferred embodiment, illustrating the magazine member in a horizontal position.

When the sliding member 43 is disposed in the first end 313' of the guide slot 31, the upper and lower cranks 31, 32 are horizontal, and are spaced apart from each other by a first distance (W1), as shown in FIG. 6. When the sliding member 43 is disposed in the second end 313" of the guide slot 313, the upper and lower cranks 31, 32 are inclined and spaced apart from each other by a second distance (W2) smaller than the first distance (W1) (see FIG. 9), and the upper crank 31 abuts against the end of the handle 110. In this embodiment, the connecting rod 40 is inverted U-shaped in cross section, and defines a groove in a bottom surface thereof. When the sliding member 43 is disposed in the second end 313" of the guide slot 313, a top side edge of the upper crank 31 is inserted into the groove in the connecting rod 40.

Figure 7:
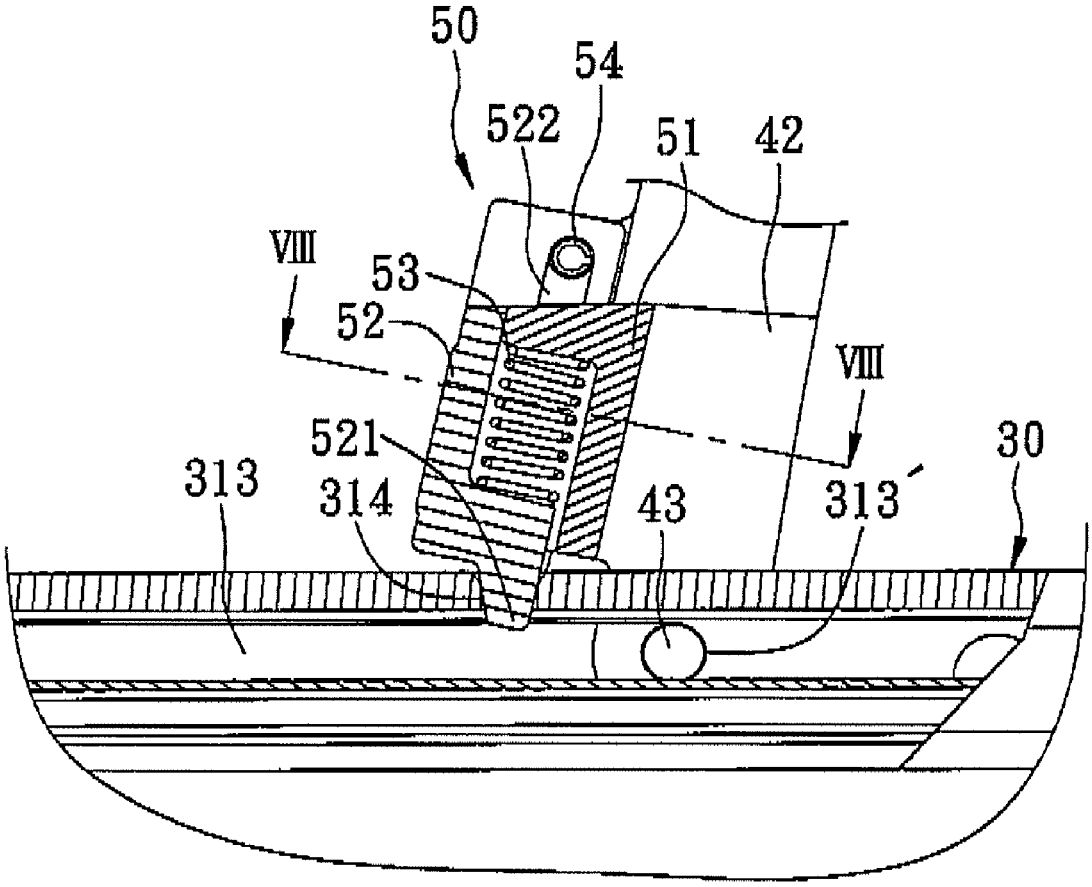
FIG. 7 is a fragmentary, partly sectional view of the preferred embodiment, illustrating a first positioning unit.
Figure 8:
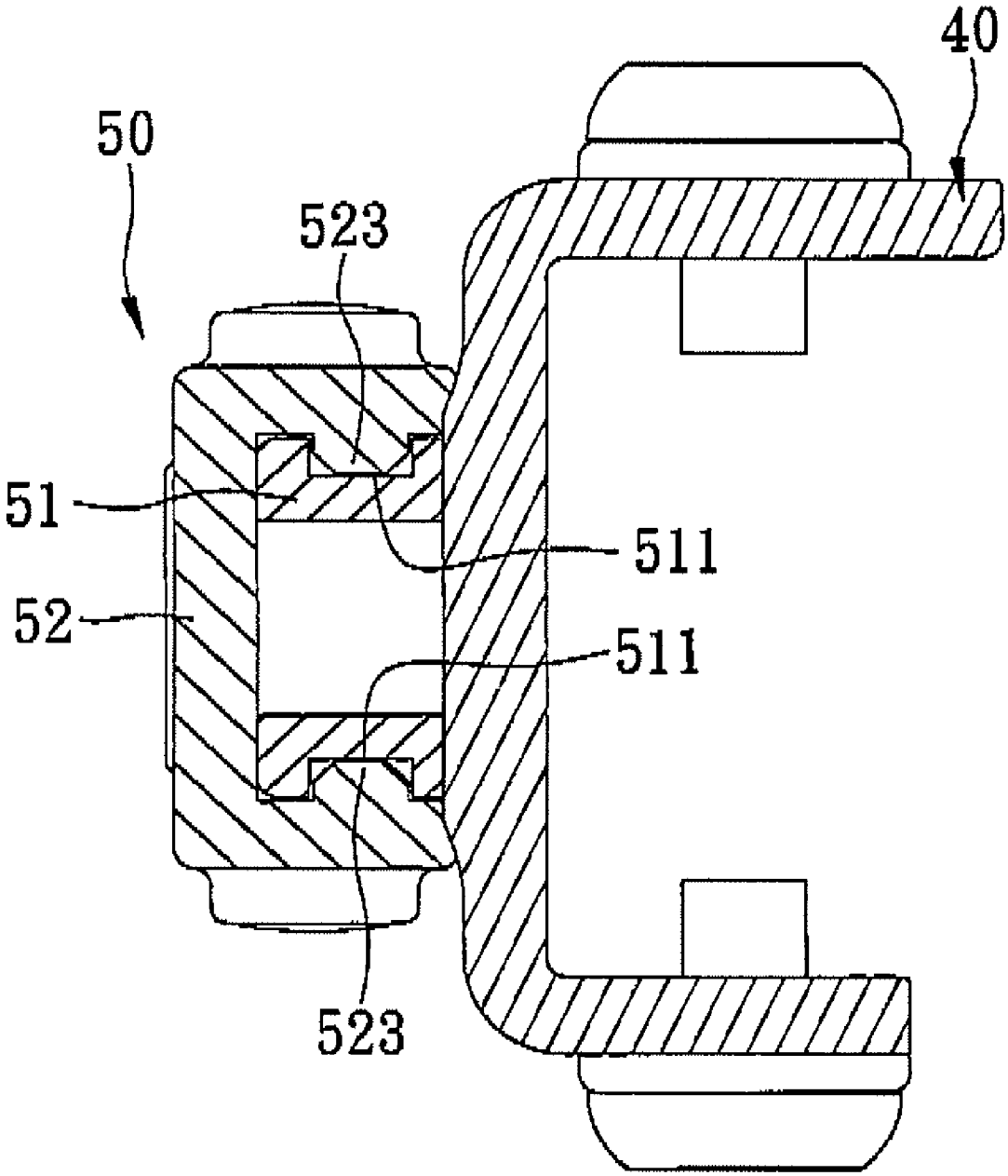
FIG. 8 is a sectional view taken along Line VIII-VIII in FIG. 7.

With further reference to FIGS. 7 and 8, the upper crank 31 further has a top surface formed with a top positioning groove 314 disposed directly above the guide slot 313 and adjacent to the first end 313' of the guide slot 313. The first positioning unit 50 includes a mounting seat 51 disposed fixedly on the lower end 42 of the connecting rod 40, a lower positioning member 52 disposed movably on the mounting seat 51, and a first resilient member 53 for biasing an engaging projection 521 of the lower positioning member 52 to move in a longitudinal direction of the connecting rod 40 to engage the top positioning groove 314 in the upper crank 31 when the sliding member 43 is disposed in the first end 313' of the guide slot 313, thereby maintaining the sliding member 43 in the first end 313' of the guide slot 313. The first resilient member 53 is configured as a coiled compression spring, and is disposed between the mounting seat 51 and the lower positioning member 52.

The lower positioning member 52 is operable to remove from the top positioning groove 314 against the biasing action of the resilient member 53 to allow the sliding member 43 to move within the guide slot 313.

In this embodiment, the mounting seat 51 has two opposite side walls formed with aligned slide slots 511. The lower positioning member 52 is formed with a limiting slot 522 parallel to the slide slots 511, and two aligned sliding ribs 523 engaging respectively and movably the slide slots 511. The first positioning unit 50 further includes a limiting pin 54 extending through the mounting seat 51 and the limiting slot 522 in the lower positioning member 52 for preventing removal of the lower positioning member 52 from the mounting seat 51.

Figure 10:
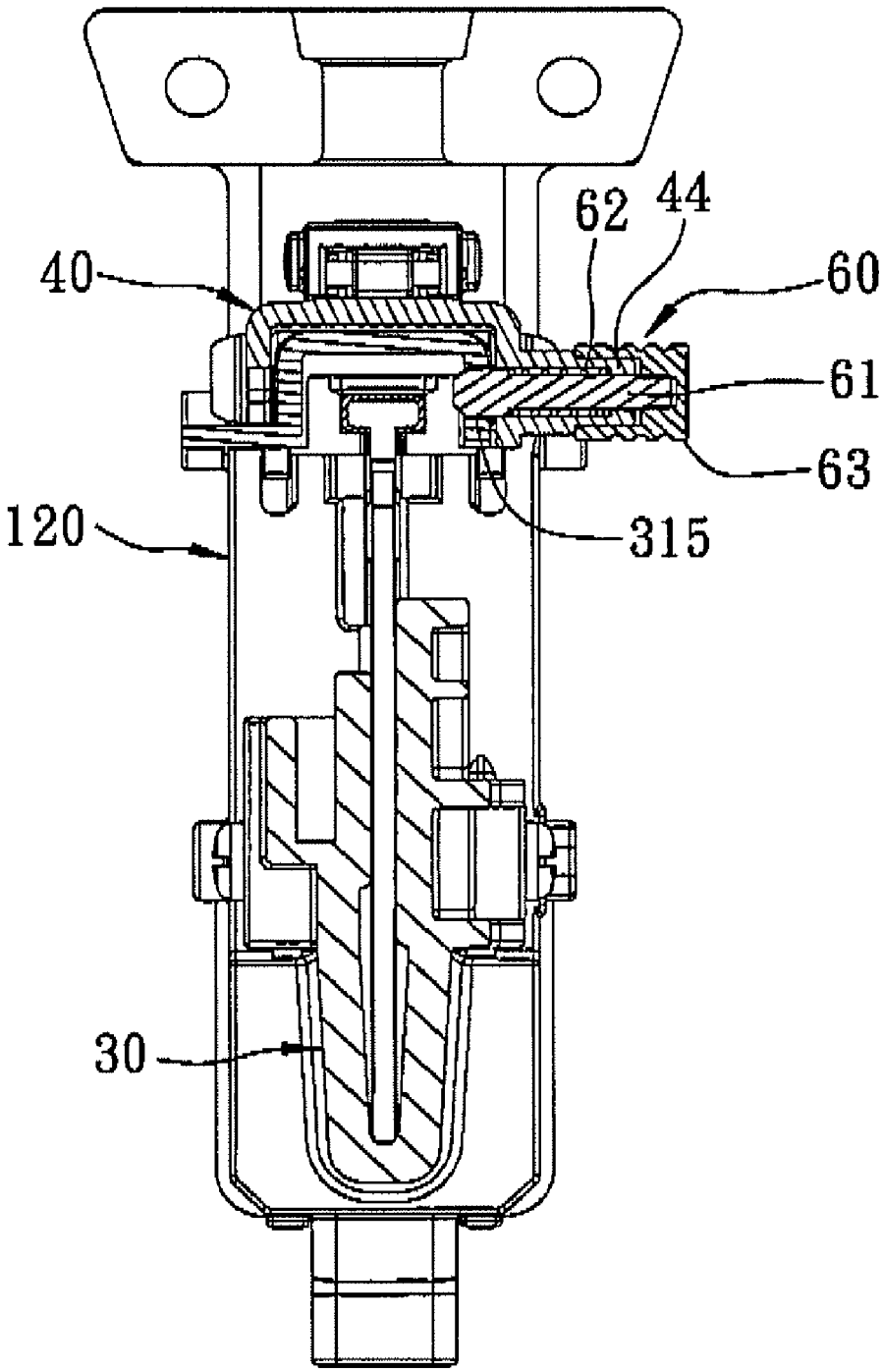
FIG. 10 is a sectional view taken along Line X-X in FIG. 9, illustrating a second positioning unit.

The upper crank 31 further has a lateral side surface formed with a side positioning groove 315 that is disposed between the guide slot 313 and the distal end 31" and that is adjacent to the first end 313' of the guide slot 313. The connecting rod 40 further includes an integral projecting tube 44 disposed between the upper and lower ends 41, 42. With further reference to FIG. 10, the second positioning unit 60 includes an upper positioning member 61 configured as a pin, a second resilient member 62, and an operating member 63. The upper positioning member 61 is disposed movably within the projecting tube 44 of the connecting rod 40. The operating member 63 is sleeved and movable on an end of the projecting tube 44. The upper positioning member 61 has a threaded end that is threaded within the operating member 63. The second resilient member 62 is disposed in the projecting tube 44 for biasing the upper positioning member 61 to move in a transverse direction of the connecting rod 40 to engage the side positioning groove 315 in the upper crank 31 when the sliding member 43 is disposed in the second end 313" of the guide slot 313, thereby maintaining the sliding member 43 in the second end 313" of the guide slot 313. The operating member 63 is operable to remove the upper positioning member 61 from the side positioning groove 315 in the upper crank 31 against the biasing action of the second resilient member 62.

Due to the presence of the parallelogram linkage, no gap is formed between the nail magazine unit and the nail ejection member 120. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. A nail gun comprising:

a body;

a handle connected fixedly to and extending laterally from said body;

a nail ejection member connected to and disposed under said body and extending along a vertical direction; and a nail magazine unit including an elongated upper crank having a proximate end proximate to said nail ejection member, and a distal end distal from said nail ejection member, an elongated lower crank disposed under and parallel to said upper crank and having a proximate end proximate to said nail ejection member, and a distal end distal from said nail ejection member, said upper and lower cranks constituting a magazine member, a first connecting member disposed on said nail ejection member and having an upper pivot portion connected pivotally to said proximate end of said upper crank, and a lower pivot portion connected pivotally to said proximate end of said lower crank such that said upper and lower cranks are pivotable relative to said nail ejection member, and a second connecting member having an upper pivot portion connected pivotally to said distal end of said upper crank, and a lower pivot portion connected pivotally to said distal end of said lower crank.

2. The nail gun as claimed in claim 1, wherein said magazine member is pivotable relative to said nail ejection member between a horizontal position whereat said magazine member is perpendicular to said nail ejection member, and an inclined position whereat said magazine member is inclined relative to said nail ejection member.

3. The nail gun as claimed in claim 1, wherein said nail magazine unit further includes a connecting rod having an upper end connected pivotally to said handle, and a lower end connected to said upper crank.

4. The nail gun as claimed in claim 3, wherein said upper crank is formed with a guide slot extending along a longitudinal direction thereof, said lower end of said connecting rod being formed with an integral sliding member disposed movably within said guide slot in said upper crank.

5. The nail gun as claimed in claim 4, wherein said guide slot in said upper crank has a first end distal from said nail ejection member, and a second end proximate to said nail ejection member, said first and second ends being positioned such that, when said sliding member is disposed in said first end, said upper and lower cranks are horizontal, and when said sliding member is disposed in said second end, said upper and lower cranks are inclined.

6. The nail gun as claimed in claim 5, wherein said upper crank is positioned relative to said handle such that, when said sliding member is disposed in said second end of said guide slot in said upper crank, said upper crank abuts against said handle.

7. The nail gun as claimed in claim 5, further comprising a first positioning unit for positioning said sliding member of said connecting rod in said first end of said guide slot in said upper crank.

8. The nail gun as claimed in claim 7, wherein said upper crank has a top surface formed with a top positioning groove, said first positioning unit including a spring-biased lower positioning member disposed at said lower end of said connecting rod and biased to move in a longitudinal direction of said connecting rod to engage said top positioning groove in said upper crank when said sliding member is disposed in said first end of said guide slot, said lower positioning member being operable to remove from said top positioning groove in said upper crank to allow said sliding member of said connecting rod to move within said guide slot in said upper crank.

9. The nail gun as claimed in claim 7, further comprising a second positioning unit for positioning said sliding member of said connecting rod in said second end of said guide slot in said upper crank.

10. The nail gun as claimed in claim 9, wherein said upper crank has a lateral side surface formed with a side positioning groove, said second positioning unit including a spring-biased upper positioning member disposed between said upper and lower ends of said connecting rod and biased to move in a transverse direction of said connecting rod to engage said side positioning groove in said upper crank when said sliding member is disposed in said second end of said guide slot, said upper positioning member being operable to remove from said side positioning groove in said upper crank to allow said sliding member of said connecting rod to move within said guide slot in said upper crank.

* * * * *